US007690426B2

(12) United States Patent
Misselbrook

(10) Patent No.: US 7,690,426 B2
(45) Date of Patent: Apr. 6, 2010

(54) METHOD OF REPAIRING FAILED GRAVEL PACKS

(75) Inventor: John Misselbrook, Calgary (CA)

(73) Assignee: BJ Services Company, Houston, TX (US)

( * ) Notice: Subject to any disclaimer, the term of this patent is extended or adjusted under 35 U.S.C. 154(b) by 273 days.

(21) Appl. No.: 11/824,060

(22) Filed: Jun. 29, 2007

(65) Prior Publication Data

US 2008/0000636 A1 Jan. 3, 2008

Related U.S. Application Data

(60) Provisional application No. 60/832,399, filed on Jul. 21, 2006, provisional application No. 60/817,605, filed on Jun. 29, 2006.

(51) Int. Cl.

| | |
|---|---|
| ***E21B 33/138*** | (2006.01) |
| ***E21B 37/06*** | (2006.01) |
| ***E21B 43/02*** | (2006.01) |
| ***E21B 43/04*** | (2006.01) |

(52) U.S. Cl. ..... 166/276; 166/171; 166/277; 166/278; 166/295; 166/300; 166/311

(58) Field of Classification Search ..... None
See application file for complete search history.

(56) References Cited

U.S. PATENT DOCUMENTS

| | | | | |
|---|---|---|---|---|
| 3,482,629 | A * | 12/1969 | Suman, Jr. | 166/255.1 |
| 3,709,298 | A * | 1/1973 | Pramann | 166/276 |
| 3,722,589 | A * | 3/1973 | Smith et al. | 166/250.01 |
| 4,428,426 | A * | 1/1984 | Davies et al. | 166/276 |
| 4,938,286 | A | 7/1990 | Jennings | 166/280 |
| 5,314,023 | A * | 5/1994 | Dartez et al. | 166/295 |
| 5,931,229 | A | 8/1999 | Lehr et al. | 166/278 |
| 6,364,018 | B1 * | 4/2002 | Brannon et al. | 166/280.2 |
| 6,450,260 | B1 * | 9/2002 | James et al. | 166/277 |
| 6,749,025 | B1 | 6/2004 | Brannon et al. | 166/305 |
| 2004/0040708 | A1 * | 3/2004 | Stephenson et al. | 166/280.1 |
| 2006/0089266 | A1 * | 4/2006 | Dusterhoft et al. | 507/219 |

FOREIGN PATENT DOCUMENTS

| | | |
|---|---|---|
| WO | WO 02/04784 | 1/2002 |

OTHER PUBLICATIONS

International Search Report for PCT application, Jan. 11, 2008.

* cited by examiner

*Primary Examiner*—George Suchfield
(74) *Attorney, Agent, or Firm*—Howrey LLP

(57) ABSTRACT

The invention is directed to controlling sand production in an oil and/or gas well. A preferred embodiment of the invention is directed to repairing a downhole screen by pumping neutrally buoyant resin coated material into a damaged portion of a gravel pack screen and also into any void behind the damaged portion of the screen. The neutrally buoyant resin provides for the repair of a portion of the screen even if the damaged portion is located on the uphole side of a deviated well. Any excess resin coated material may subsequently be removed from the central passageway of the screen and then circulated to the surface because the resin coated material is neutrally buoyant. Neutrally buoyant resin may be pumped into a well that does not have a sand control system. The porous neutrally buoyant resin allows production of hydrocarbons, but prevents production of sand into the well.

28 Claims, 10 Drawing Sheets

METHOD OF REPAIRING FAILED GRAVEL PACKS

This application is a non-provisional application claiming priority to U.S. Provisional Application Ser. No. 60/832,399, entitled "METHOD OF REPAIRING FAILED GRAVEL PACKS" by John Misselbrook, filed Jul. 21, 2006, and U.S. Provisional Application Ser. No. 60/817,605, entitled "METHOD OF REPAIRING FAILED GRAVEL PACKS" by John Misselbrook, filed Jun. 29, 2006.

BACKGROUND OF THE INVENTION

1. Field of the Invention

The present invention is directed to repairing failed gravel pack screens in an oil and/or gas well. More particularly, one embodiment of the invention is directed to repairing the screen by pumping an ultra-lightweight or neutrally buoyant resin coated material into the screen into the hole(s) in the screen and into any void behind the screen. Any excess resin coated material is subsequently removed from the central passageway of the screen. Other embodiments of the present invention involve controlling sand production in cased wells.

2. Description of the Related Art

One problem facing the oil and gas industry is preventing reservoir sand from being produced with the hydrocarbons into the wellbore, which can build up and restrict hydrocarbon production. An increasing number of reservoirs are being drilled horizontally and many of these wells often require sand control measures to prevent the buildup of sand beds in the well. To prevent and control reservoir sand, a mechanical filter may be placed between the wellbore and the formation. The filter often consists of a media, such as gravel or sand, placed between a screen and the formation. The media is carefully sized to allow the passage of hydrocarbons from the formation, but to prevent the majority of sand and particles that constitute the rock formation from passing into the well and possibly plugging it up.

For many years, the filter system commonly used comprised of media placed between a wire screen and the formation (or casing). The screen typically includes a base pipe that, depending on the size of the openhole or casing, may typically be 3.5 inch or 4 inch in diameter, although both larger and smaller sizes are in regular use. The screen base pipe would typically have a plurality of holes (e.g., ⅜ inches in diameter) drilled through the base pipe. By way of example, 50 or 60 holes per foot may be drilled in the base pipe. The base pipe gives the screen its strength. A plurality of ribs are welded longitudinally along the outer diameter of the base pipe. A wire is then wound around the outer diameter of the base pipe and ribs, the ribs generally provide a small standoff between the wire and base pipe. As the wire is wrapped around the base pipe, the space between successive wraps is sized to be smaller than the filter media, such as gravel, sand, or ceramic shapes placed between the screen and the reservoir rock or casing. Other configurations using wire mesh layers wound around a perforated base pipe are also in common use.

Clean, approximately spherical sand has been one type of media used to prevent the flow of larger particles from the formation to the wellbore. The screen is sized to effectively hold the sand in place against the formation. Properly packing the sand behind the screen can be challenging especially in long horizontal wellbores and could lead to problems with the effectiveness of the filter system. One method of packing the sand behind the screen is done by pumping water, sometimes with a polymer, to circulate the sand down behind the screen and allowing the sand to pack off at the bottom of the screen and formation interface while taking liquid returns through the screen and back to the surface. Gradually the packed sand builds up behind the screen until a uniform, annular sand pack is created between the screen and the formation. An alternative method to create the media sand pack is just pumping the sand and water into the annular cavity between the screen and formation and then squeezing the annular area and letting the liquid just disappear off into the formation.

The sand may not be uniformly compacted in the annular area regardless of what method is used. Achieving a uniformly compacted media behind a screen is sometimes difficult. For example, the screen may not be fully centered within the wellbore, there may be an area that takes fluid more readily than another part of the open hole sections, or there may be excessive liquid lost to the formation. Each of these can result in the sand behind the screen not being perfectly compacted and consolidated.

After the media is in place the well is put into production and reservoir fluids start flowing out of the rock formation through the annular area of filter media, through the screen, and up to the surface. There may be a significant pressure drop between the reservoir and the wellbore if the well is being drawn on to encourage the reservoir to produce. Voids may develop in the sand media if it was not uniformly distributed and compacted behind the screen. The hydrocarbons will preferentially flow to these voids due to there being less resistance than other portions of the media possibly creating a flow channel, which also provides for a higher velocity of flow. The absence of the media also permits the flow of very small (i.e. fine), reservoir particles through the channel.

These "fine" particles travel close to the same velocity as the hydrocarbons and over time these "fine" particles can erode a hole through the screen. A hole in the screen allows larger formation sand particles to be produced through the hole and deposited into the wellbore. Eventually, the sand build up may reach a point that it impedes production until the wellbore is cleaned out. After the cleanout of the wellbore, the sand control system preferably needs to be repaired to prevent a repeat of this problem.

Traditionally a repair would mean removing the screen and filter media and reinstalling a complete new filtering system. This process is very expensive due to the rig costs required to remove the screen and re-install a new screen. The cost also varied depending on how long the screen was. Due to the great expense in this process, a well operator had to determine how many reserves were potentially left in the well to evaluate whether the removal and repair of the screen was an economical procedure. One potential solution to fixing the screen that was not as costly was to run another screen inside the existing screen.

Although inserting a replacement screen within an existing screen may not be as expensive, it also has it limitations. Gravel pack completions on horizontal wells can extend over a thousand feet or longer and rectifying a failure using an insert screen over the whole length can be prohibitively expensive.

In a horizontal well, the existing filter may extend over thousands of feet long and the screens used in these applications can cost hundreds of dollars per foot. Thus, it may not be economical to insert a 2000 foot screen when only a small portion of the existing screen has been damaged. Furthermore, the rig and consequential workover costs associated with placing an insert screen inside a failed screen can also be significant.

Instead of inserting a replacement screen along the whole length, one possible solution is to install an insert screen across the damaged area. This could be possible if there was a technology available to readily locate where the existing screen had failed. The failure normally occurs in the wire or mesh behind the base pipe making failure location especially difficult. Because the screen itself is porous, it allows reservoir fluid to flows in and across the screen further compounding the difficulty of locating the failure. Presently there is no effective technology that may be run into the well to easily determine where the screen failure is located.

There are other limitations of whether insert screens may be used. For example, the size of the well may be too small to accommodate the insertion of another screen. An insert screen may be used as a purely mechanical screen or it may be used in conjunction with media between the existing screen and the insert. Although using media between the insert screen and the existing screen may provide better filtering capabilities it may also affect the production of the well. The use of an insert screen and filter media will normally limit the flow of hydrocarbons as now the hydrocarbons will have to flow through a smaller cross-sectional area resulting from the smaller annular ring of filter material. For the same pressure drop the flow through that smaller cross-sectional flow area is necessarily lower. Additionally, the insert screen reduces the internal diameter of the wellbore and limits options for future intervention operations.

As an alternative to installing insert screens inside a failed screen, one method to repair the failed screen is to try to squeeze resin coated sand into the screen in an effort to repair the failure. It was speculated that the resin coated sand would penetrate through the failure and into the void in the media behind the failure. The resin coated sand would then set up and harden preventing further sand ingress. The success of this method has typically been low and is often employed as a last resort.

One reason for the limited success is that resin coated sand is generally over 2.5 times heavier than water. The resin coated sand is mixed with water and pumped into the hole down to the screen. While the water will flow through the screen, in a vertical well the resin coated sand tends to fall into the bottom of the hole instead of penetrating into the screen and void behind the screen because the resin coated sand is heavier than the water. In a horizontal well, it can be even more difficult to repair a hole on the high side of the well. Gravity causes the resin coated sand to collect at the bottom side of the screen because it is heavier than the water or fluid it is pumped with.

In some instances, a cased well may not include a mechanical sand control system, such as a filter comprised of media and a screen, as discussed above. During the production of hydrocarbons the formation may begin to produce sand along with the hydrocarbons, which enters the cased well because no mechanical sand control system is present. The sand can build up within the well restricting the production of hydrocarbons as discussed above. It would be beneficial to provide a short term solution to control the production of sand providing for the production of hydrocarbons while a rig is procured to install a mechanical sand control system within the well. Alternatively, it may be beneficial to provide a sand control system that prevents the production of sand and that may be established within the cased well without the need of a rig. The sand control system may include a material that bridges within the perforation tunnels of the well. Such a sand control system may be more cost effective than the traditional mechanical sand control systems.

In light of the foregoing, it would be desirable to provide a method of repairing a gravel pack failure downhole even if the failure is located on the high side of a deviated or horizontal well. It would also be desirable to provide a material that is able to penetrate the screen failure and the void behind the failure to build up and prevent further ingress of reservoir sand and formation particles. It would be desirable to provide a repair material that is able to locate a failure in a downhole screen. It would further be desirable to provide a repair material that may repair a failed screen such that excess repair material may be readily removed from the wellbore. It would also be desirable to provide a material that may be used as a temporary sand control system within a cased well until a mechanical sand control system can be installed into the cased well. It would further be desirable to provide a method of squeezing a neutrally buoyant material into perforation tunnels in a cased well that may prevent the production of sand into the cased well.

The present invention is directed to overcoming, or at least reducing the effects of, one or more of the issues set forth above.

SUMMARY OF THE INVENTION

One embodiment of the invention provides a method for controlling sand production in a well including the injecting a fluid carrying an ultra-lightweight or neutrally buoyant proppant into a well so that said fluid carrying the proppant flows into one or more areas of lower resistance to fluid flow. Such areas of lower resistance to fluid flow may include a hole or holes in the screen of a gravel pack as well as perforation tunnels in a cased well. Additional examples of areas of lower resistance to fluid flow will be apparent to one skilled in the art with the benefit of this disclosure. The proppant will be packed in the areas of lower resistance to fluid flow as the carrier fluid flows into these areas. A displacement fluid may be used to displace the carrier fluid and proppant in the areas of lower resistance to flow. The packing of neutrally buoyant proppant occurs as the proppant accumulates in the areas of lower resistance to fluid flow and bridges off against, for example, the damaged section of the gravel pack and/or the formation.

The proppant used to repair the failed gravel pack (or to consolidate a weakened formation behind casing) must be reliably transported into the void or hole by a suitable carrier fluid. To ensure that the carrier fluid readily penetrates any voids or holes requires a low viscosity fluid. Low viscosity fluids generally have poor particle suspension properties and so it is desirable to limit the contrast between the carrier fluid density and the proppant or repair particle density. Conventional proppants (e.g., sand and ceramics) used in gravel packing operations have specific gravities in the range of 2.65 to 2.7 and sometimes higher. Typical gravel packing fluids are water based with specific gravities between 1.0 and 1.2. A fluid system with a particle that's twice the density of the liquid will typically exhibit poor particle suspension. A neutrally buoyant particle will stay dispersed in its carrier fluid. Furthermore, an ultra-lightweight (compared to sand or ceramics) particle that is only marginally heavier than its carrier fluid will stay dispersed if the carrier fluid is in motion, as would be the case while it is being pumped downhole and into the areas in need of repair.

As stated above, neutrally buoyant proppant is generally preferred since matching the specific gravity of the carrier fluid and the proppant will minimize the settling of the proppant in the well and maximize the flow of the proppant with the carrier fluid into areas of lower resistance to fluid flow. Ultra-lightweight proppants may also be used in accordance with the claimed invention since ultra-lightweight proppants have a specific gravity that is substantially lower than the specific gravity of conventional proppants such as sand and will stay dispersed when the carrier fluid is in motion. For the purpose of this invention only, a proppant is considered to be an ultra-lightweight proppant if it has a specific gravity of about 1.5 or less.

The proppant used to repair the downhole screen may be the ultra-lightweight or neutrally buoyant particulate materials disclosed in U.S. Pat. No. 6,364,018 entitled "Lightweight Methods and Compositions for Well Treating" issued Apr. 2, 2002 or in U.S. patent application Ser. No. 10/653,521 entitled "Method of Treating Subterranean Formations with Porous Ceramic Particulate Materials" filed Sep. 2, 2003 each being assigned to BJ Services Company. Likewise, the ultra-lightweight or neutrally buoyant proppant may be the neutrally buoyant particulate material disclosed in U.S. patent application Ser. No. 10/824,217 entitled "Method of Treating Subterranean Formations with Porous Ceramic Particulate Materials" filed Apr. 14, 2004. The above patent and patent applications disclose the use of a particulate material in the stimulation of a well. In particular, U.S. patent application Ser. No. 10/824,217 discloses the use of porous particulate material including the use of porous ceramic particulate materials and porous organic polymeric materials for use as ultra-lightweight or neutrally buoyant particulate materials. Each of the above patent and patent applications is incorporated herein in its entirety by reference.

One embodiment of the present invention provides an ultra-lightweight or neutrally buoyant material and method to use the material to repair a failure in a downhole screen. As the proppant is ultra-lightweight or neutrally buoyant, the proppant will stay substantially dispersed in the carrier fluid and will be carried to the locations within the well that the fluid flows to. The fluid will flow to the area of least resistance within the well. The ultra-lightweight or neutrally buoyant proppant will flow with the flow of the fluid thereby allowing the proppant to fully penetrate the void. The fluid may be continually pumped downhole into the screen until the proppant builds up within the void and bridges off against the formation.

According to a preferred embodiment, the proppant includes a reactive coating capable of binding proppant particles together. A curable resin would be a preferred reactive coating for the ultra-lightweight or neutrally buoyant proppant. Alternatively, the ultra-lightweight or neutrally buoyant proppant may be entirely comprised of deformable particles or may be comprised of a mixture of deformable particles with other ultra-lightweight or neutrally buoyant proppants so that the proppant particles can be mechanically "locked" in place. Other means of binding or locking the proppant particles together or in place will be apparent to one skilled in the art with the benefit of this disclosure.

In one embodiment, the repair material is an ultra-lightweight or neutrally buoyant resin coated material that may be pumped downhole with a fluid carrier to penetrate the void behind the screen failure and bridge off against the formation. There are numerous materials that may be used in this application as would be recognized by one of ordinary skill in the art having the benefit of this disclosure. For example, one applicable neutrally buoyant material may be an ultra-lightweight proppant such as LITEPROP™ offered by BJ Services Company. Additionally, an ultra-lightweight or neutrally buoyant plastic such as divinylbenzene ("DVB") could be used in the application.

As discussed above, a low viscosity liquid will be used to carry the proppant downhole to the failed screen. The liquid may flow through the screen into the formation, but the ultra-lightweight or neutrally buoyant proppant particles are sized bigger that the openings in the screen. Thus, the proppant particles will build up a layer on the inside of the screen. The proppant particles may be porous, thus allowing fluid to flow from the formation into the well even through a layer of proppant particles has been built up on the inside of the screen.

As discussed above, the downhole screen generally consists of a base pipe with holes and a screen wrapped around the exterior of the base pipe. Often a small annular gap may exist between the exterior of the base pipe and the screen due to the structural ribs on the exterior of the base pipe. The proppant will go through the holes in the base pipe, and collect against the wire wrap. The proppant is sized such that it cannot pass through the wire wrap. If there is a hole in the wire wrap, then the proppant will be carried by the fluid through the hole. As the proppant is pumped downhole it can fill up all the holes in the base pipe as well as the small annular gap between the base pipe and the wire wrap. The buildup of proppant particles does not prevent fluid flow through the base pipe hole or the wire wrap because the proppant is porous.

As stated above, in some preferred embodiments, the reactive coating capable of binding the ultra-lightweight or neutrally buoyant proppant particles together is a resin. In one embodiment, the proppant particles are coated with a resin that is thermally set. The bottom hole temperature may cause the resin to set and thus, the proppant particles packed together will stick together and cure. In another embodiment, the ultra-lightweight or neutrally buoyant proppant particles are coated with a resin that sets due to pressure. When pumping the fluid filled with the ultra-lightweight or neutrally buoyant proppant particles downhole the proppant particles stack up in the void, on the screen, and against the pipe. The pressure of the pumping fluid squeezes the stacked proppant particles together causing the resin to set. A high pressure drop across the screen during fluid injection will cause all of the resin coated proppant particles to become compacted together and this contact source may generate enough pressure to have the resin to stick to itself.

In another embodiment, pressure in the wellbore can cause the proppant particles to compact together, but depending on the resin this may not be sufficient to set the resin. To set the resin, an activator may then be pumped into the wellbore to cause the resin to set causing the proppant particles to stick together.

Once the resin is set, the operator of the well may wait a period of time to allow the resin to cure in place. As discussed above, the resin coated ultra-lightweight or neutrally buoyant proppant particles may have filed the base pipe holes. Additionally, the proppant particles may have built up on the bore of the base pipe. A motor and a mill located on the bottom of the coiled tubing may be run into the well. The motor and mill are sized to go inside the base pipe and break up any lumps or nodes of resin coated ultra-lightweight or neutrally buoyant proppant particles that have built inside the pipe and present a possible obstruction to moving forward. Because the lumps or nodes are comprised of ultra-lightweight or neutrally buoyant particles, they will be easily circulated from the wellbore by the fluid being used to drive the drill motor. The relatively low strength of the ultra-lightweight or neutrally buoyant proppant ensures that it is easy to mill out.

In one embodiment, the ultra-lightweight or neutrally buoyant proppant particles are sized to be at least as large as the filter media behind the screen. This will allow the proppant particles to pass any particles that have passed through the media. If the ultra-lightweight or neutrally buoyant proppant particles are sized smaller than the filter media, the proppant particles may plug up the formation. Generally a particle that's between ⅓ and 1/7 of the media pore throat diameter will actually flow into the gap between the proppant particles, but ultimately will bridge off. Typically, proppant particles smaller than 1/7 of the pore throat diameter will flow all the way through. The pore throat diameter is a function of the size of the filter media particle. Thus, the bigger the filter media particles or proppant particles, the bigger the pore throat diameter.

Another embodiment of the present disclosure is an ultra-lightweight or neutrally buoyant particle that is chemically resistant. Chemicals may be used to clean up the filter or to stimulate a portion of the rock formation. It may be important to be able to pump chemicals downhole and not dissolve or destroy a previous repair made to a screen with ultra-lightweight or neutrally buoyant particles.

One embodiment of the present disclosure is a method of repairing a downhole gravel pack screen that includes the step of squeezing an ultra-lightweight or neutrally buoyant curable resin coated proppant, into the damaged screen. The ultra-lightweight or neutrally buoyant proppant will not readily gravity segregate in a horizontal well and thus would be more readily transported in to the hole in the screen and any voids or crevices behind the hole. This is especially important in longer intervals, e.g., horizontal wells where contact with the reservoir is very large and fluid leak-off to the formation will be high at relatively low squeeze pressures. Maintaining the curable resin coated material in buoyant state will improve the transport of proppant into the hole. This is especially the case when the hole is on the high side of the screen.

In a preferred embodiment, the repair method would comprise the step of cleaning the hole with coiled tubing. The method further includes the step of spotting a fluid pill with a controlled amount of resin coated ultra-lightweight proppant in to the screen while pulling the coiled tubing out of the screen. The method includes the step of squeezing the pill into the screen. If the squeeze pressure is not sufficient to cure the resin, the method could further include the step of pumping a resin curing activator into the screen. The method further includes the steps of allowing the resin to cure and milling out any excess proppant from inside the screen using a motor and low aggressive bit. This method does not require locating the exact location of the hole within the screen since it is possible to spot a fluid within the entire length of the screen and the entire wellbore may be squeezed. In addition, the ultra-lightweight or neutrally buoyant proppant will be easier to mill than resin coated sand and may be removed easier because the cuttings are ultra-lightweight or neutrally buoyant.

One embodiment of the present disclosure is a method to repair a failed gravel pack within a well comprising cleaning the well with coiled tubing and running a selective placement tool into the well on the end of coiled tubing. The method further comprises pumping fluid with resin coated ultra-lightweight or neutrally buoyant proppant into the well. The selective placement tool may be used to divide the well into discrete sections prior to pumping the fluid with resin coated ultra-lightweight or neutrally buoyant proppant into the well. The division of the well into discrete sections may provide effective placement of the resin coated ultra-lightweight or neutrally buoyant proppant within the failed gravel pack.

The selective placement tool may include two packers using a fixed straddle length. The selective placement tool may be comprised of a number of different tools and configurations, such as a multi-set bridge plug, release tool, and packer, as would be appreciated by one of ordinary skill in the art having the benefit of this disclosure. Alternatively a single retainer style packer could be used that allows fluid with resin coated ultra-lightweight or neutrally buoyant proppant to be pumped below the packer into the well. The single retainer style packer may be progressively moved up the well allowing the fluid with resin coated ultra-lightweight or neutrally buoyant proppant to be pumped into the well in stages. Because the resin coated proppant is ultra-lightweight or neutrally buoyant it remains dispersed in the wellbore fluid reducing the chance that the proppant may settle within the wellbore and build up into a bed, which could cause the selective placement tool to become stuck within the wellbore.

One embodiment of the present disclosure is a method of preventing the production of sand in a cased well. A cased well may not include a mechanical sand control system such as a screen that prevents the production of sand into the well. Thus, during the production of hydrocarbons the formation may also begin to produce sand into the well. The method of preventing the production of sand includes squeezing an ultra-lightweight or neutrally buoyant curable resin coated material, e.g., an ultra-lightweight proppant, into the perforation tunnels of the well. The ultra-lightweight or neutrally buoyant material will not readily gravity segregate in a horizontal well and thus would be more easily transported into the perforation tunnels. The ultra-lightweight or neutrally buoyant material may bridge within the perforation tunnels preventing the production of sand into the cased well. The ultra-lightweight or neutrally buoyant material would be porous allowing hydrocarbons to pass, but preventing sand from entering the cased well. Alternatively, ultra-lightweight or neutrally buoyant material may be squeezed into the cased well to form a temporary barrier within the cased well preventing the production of sand into the cased well. Hydrocarbons may still be produced because the ultra-lightweight or neutrally buoyant material is porous. The temporary barrier may allow production of hydrocarbons to continue until a rig is procured to install a mechanical sand control system.

Figure 1:
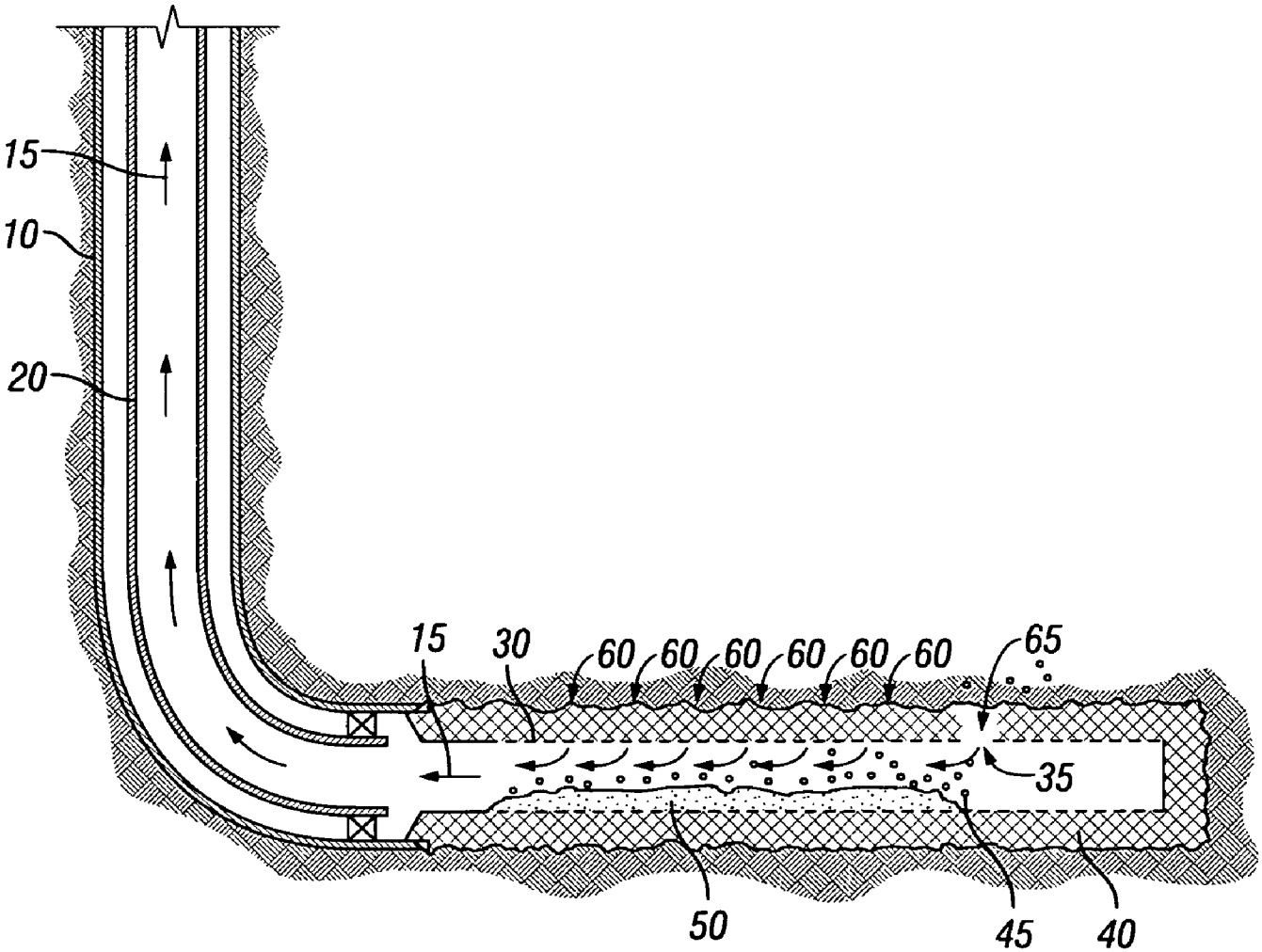
FIG. 1 illustrates a horizontal wellbore producing reservoir fluids 60 through a damaged gravel 40 packed screen 30 that has a hole 35.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures.

FIG. 1 depicts a well that is producing hydrocarbons. The hydrocarbons exit the reservoir fluids 60 flowing through the filter media 40 and screen 30 and then travel to the surface through production tubing 20 within the well casing 10 as indicated by the flow arrows 15. A portion of the screen 30 has failed such that a hole 35 allows sand 45 and hydrocarbons to flow 65 out of the reservoir. Upon entering the wellbore, the sand 45 deposits on the low side of the well forming a sand bed 50.

As the sand bed 50 increases in size, the flow 15 through the production tubing 20 decreases. The decease in flow 15 may cause the operator to put a higher draw on the reservoir, which may cause the production of water as well as hydrocarbons. In such situations, the wellbore may need to be cleaned out to remove the sand bed 50 and then the screen 30 needs to be repaired to prevent the formation of a sand bed when the well is turned back to production.

Figure 2:
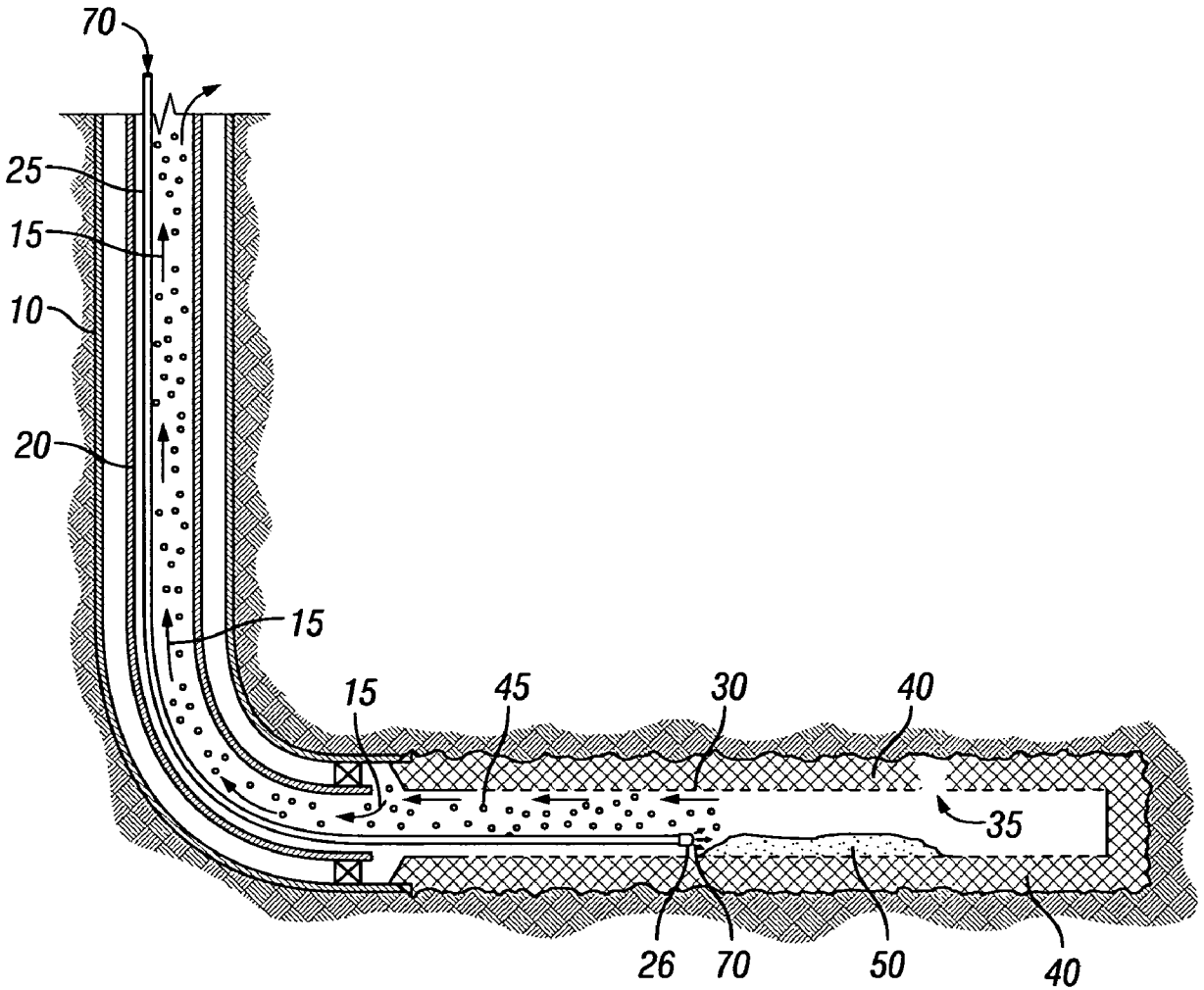
FIG. 2 illustrates one embodiment of the present disclosure where coiled tubing 25 is used to remove the sand bed 50 and clean the sand 45 out of the wellbore.

FIG. 2 depicts one embodiment of the present disclosure that may used to clean out the wellbore. Production of the wellbore may be stopped and coiled tubing 25 ran into the wellbore until a wash nozzle 26 is located adjacent to the sand bed 50. The wash nozzle 26 may be any applicable downhole device, such as a TORNADO® Coiled Tubing Nozzle offered by BJ Services Company, that may be used to remove fill such as a sand bed from a well bore. Cleanout out fluid 70 is pumped down the coiled tubing 25 to the wash nozzle 26 breaking up the sand bed 50. The sand 45 is then carried with the fluid and the fluid flow 15 carries the sand 45 to the surface where it can be disposed. It is important that the sand is properly cleaned out of the wellbore. If sand 45 remains on the low side of the hole it may interfere with providing ultra-lightweight or neutrally buoyant proppant to all areas of the screen 30 as discussed below.

Figure 3:
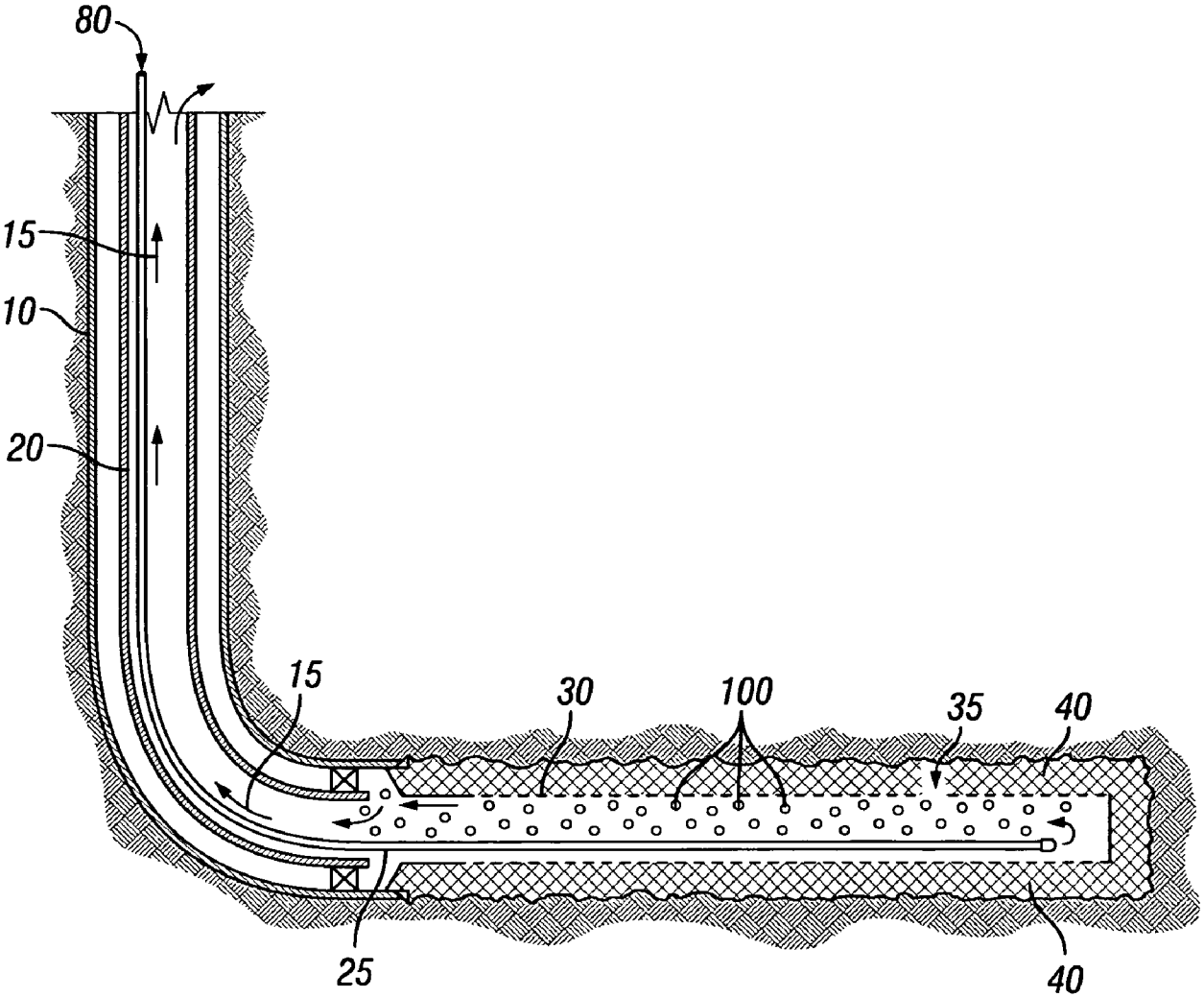
FIG. 3 illustrates displacing the wellbore fluid with a carrier fluid 80 containing ultra-lightweight or neutrally buoyant proppant 100.

Once the sand is cleaned out the well as shown in FIG. 3, carrier fluid 80 may be pumped to the wellbore through the coiled tubing 25. The coiled tubing 25 is positioned to begin injecting the carrier fluid 80 and ultra-lightweight or neutrally buoyant proppant 100 at the toe of the well. The carrier fluid 80 may be comprised of a variety of fluids such as water, brine, or sea water, as would be appreciated by one of ordinary skill in the art having the benefit of this disclosure. The carrier fluid 80 carries ultra-lightweight or neutrally buoyant proppant 100 downhole. The carrier fluid 80 displaces the fluid previously located in the well bore and this fluid flows 15 up the annulus between the coiled tubing 25 and the production tubing 20. The specific gravity of the carrier fluid 80 may be modified depending on well conditions. Additives could also be added to the carrier fluid 80, which may change the overall specific gravity of the carrier fluid 80. Thus, a different number of ultra-lightweight or neutrally buoyant proppants 100 may be available for use depending on the composition of the carrier fluid 80. The specific gravity of the carrier fluid 80, when compared to the specific gravity of the ultra-lightweight or neutrally buoyant proppant being utilized indicates whether or not the proppant is neutrally buoyant. The ultra-lightweight or neutrally buoyant proppant 100 is not required to have a specific gravity that matches the specific gravity of the carrier fluid 80 (i.e., neutrally buoyant proppant). Specifically, using proppants with specific gravities of about 1.5 or less (i.e., proppants considered to be ultra-lightweight proppants for the purpose of the instant invention) will achieve substantially the same results as utilizing neutrally buoyant proppants.

The carrier fluid 80 needs to be chosen to not damage or react to the ultra-lightweight or neutrally buoyant proppant 100. In one embodiment, a well service provider may have a larger range of ultra-lightweight or neutrally buoyant proppants 100 to accommodate a wide range of standard carrier fluids 80 depending on the needs of the well. Alternatively, the well service provider may have a small number of ultra-lightweight or neutrally buoyant proppants 100. In this instance, the specific gravity of the fluid may be adjusted, possibly by the addition or deletion of additives, to match or nearly match the specific gravity of one of the neutrally buoyant proppants.

Figure 4:
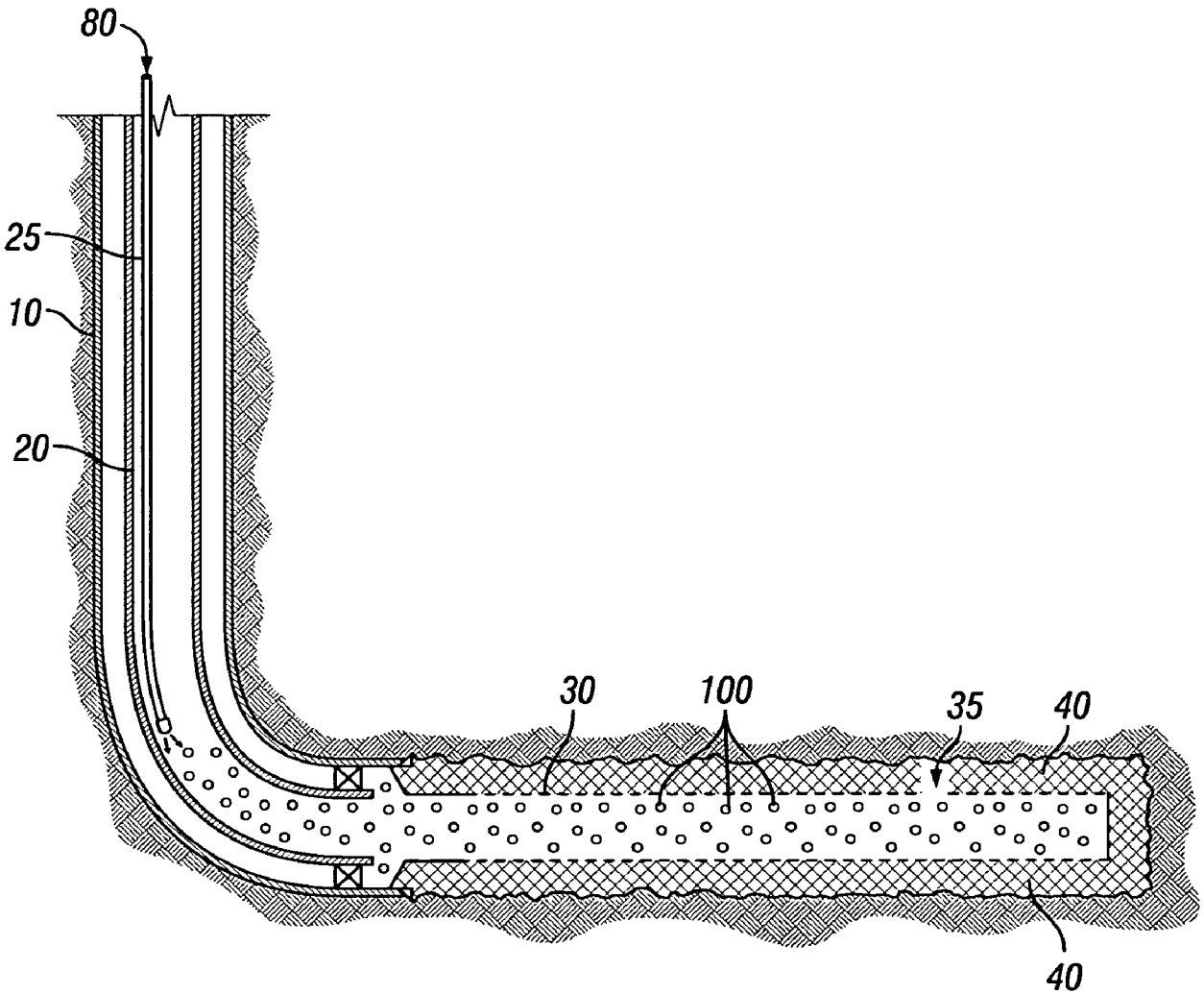
FIG. 4 illustrates displacing the wellbore fluid and placing ultra-lightweight or neutrally buoyant proppant 100 within the screen 30 while pulling the coiled tubing 25 into the production tubing 20.
Figure 5:
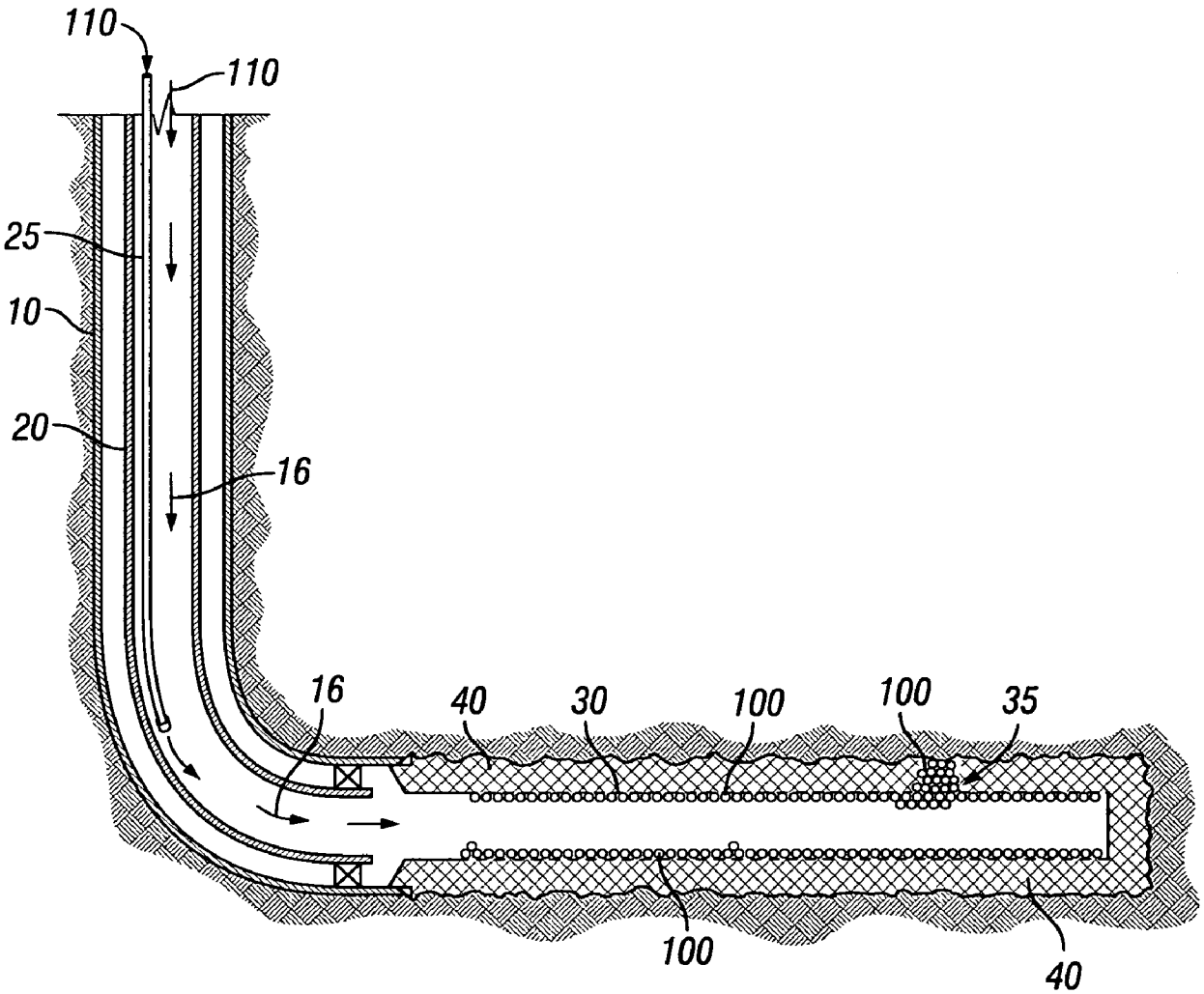
FIG. 5 illustrates pumping displacement fluid 110 into the wellbore to displace the carrier fluid through the screen 30 causing ultra-lightweight or neutrally buoyant proppant 100 to invade a hole 35 in the screen 30.

FIG. 4 depicts the coiled tubing 25 pulled back into the production tubing 20 and the lower half of the well is full of carrier fluid 80 and neutrally buoyant proppant 100. After the coiled tubing 25 has been pulled up into the production tubing 20 and the lower half is full of the carrier fluid, displacement fluid 110 is pumped down the coiled tubing 25 and the production tubing 20 as indicated by the flow arrows 16 in FIG. 5. The displacement fluid 110 squeezes the well causing the carrier fluid 80 to flow into the reservoir through the screen 30 and the filter media 40. The ultra-lightweight or neutrally buoyant proppant 100 flows with the carrier fluid 80, but is sized such that it cannot flow through the screen 30. Thus, the ultra-lightweight or neutrally buoyant proppant 100 builds up on the inside the screen 30 due to the displacement fluid 110. The displacement fluid 110 also causes the ultra-lightweight or neutrally buoyant proppant 100 to flow into the hole 35 in the screen 30 and bridge off against the formation.

Figure 6:
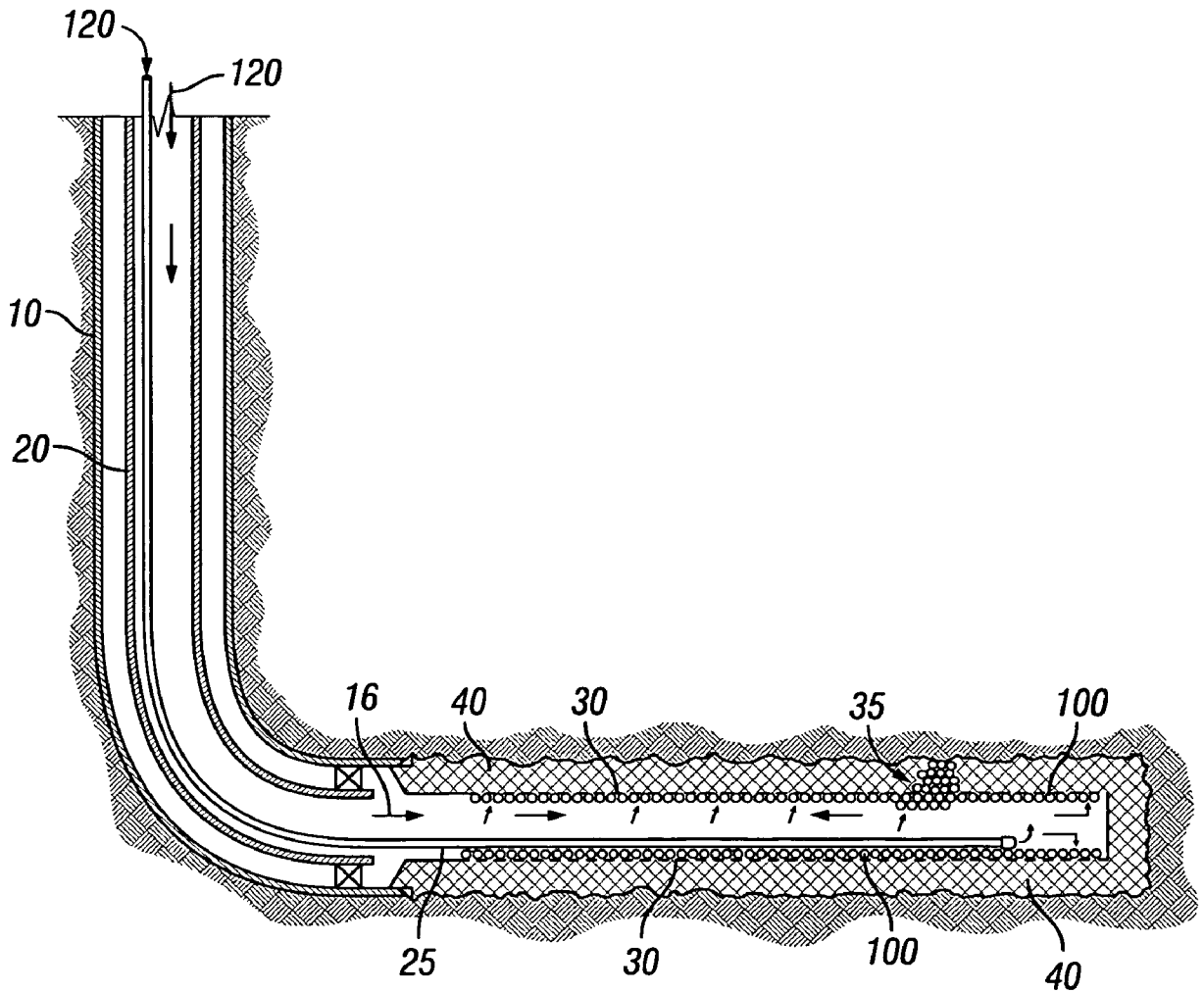
FIG. 6 illustrates an embodiment of the present disclosure wherein a resin actuator 120 is spotted and squeezed into the screen area 30 setting the ultra-lightweight or neutrally buoyant proppant 100.

The ultra-lightweight or neutrally buoyant proppant 100 is now packed against the screen 30 and bridged off against the formation in the hole 35. In a preferred embodiment, the ultra-lightweight or neutrally buoyant proppant 100 may be coated with a reactive coating capable of binding proppant particles together. In another preferred embodiment, the reactive coating capable of binding the proppant particles together is a resin. The resin may be set by the pressure applied during the pumping of the displacement fluid 110 or alternatively, the downhole temperature may set and cure the resin. Alternatively, a resin activator 120 may be pumped down the coiled tubing 25 and production tubing 20 as indicated by the flow arrows 16 in FIG. 6. The resin activator 120 may cause the resin to set thus plugging the hole 35 in the screen. The operator of the well may then allow the resin to cure for a specified amount of time before any further action is done on the well.

Figure 7:
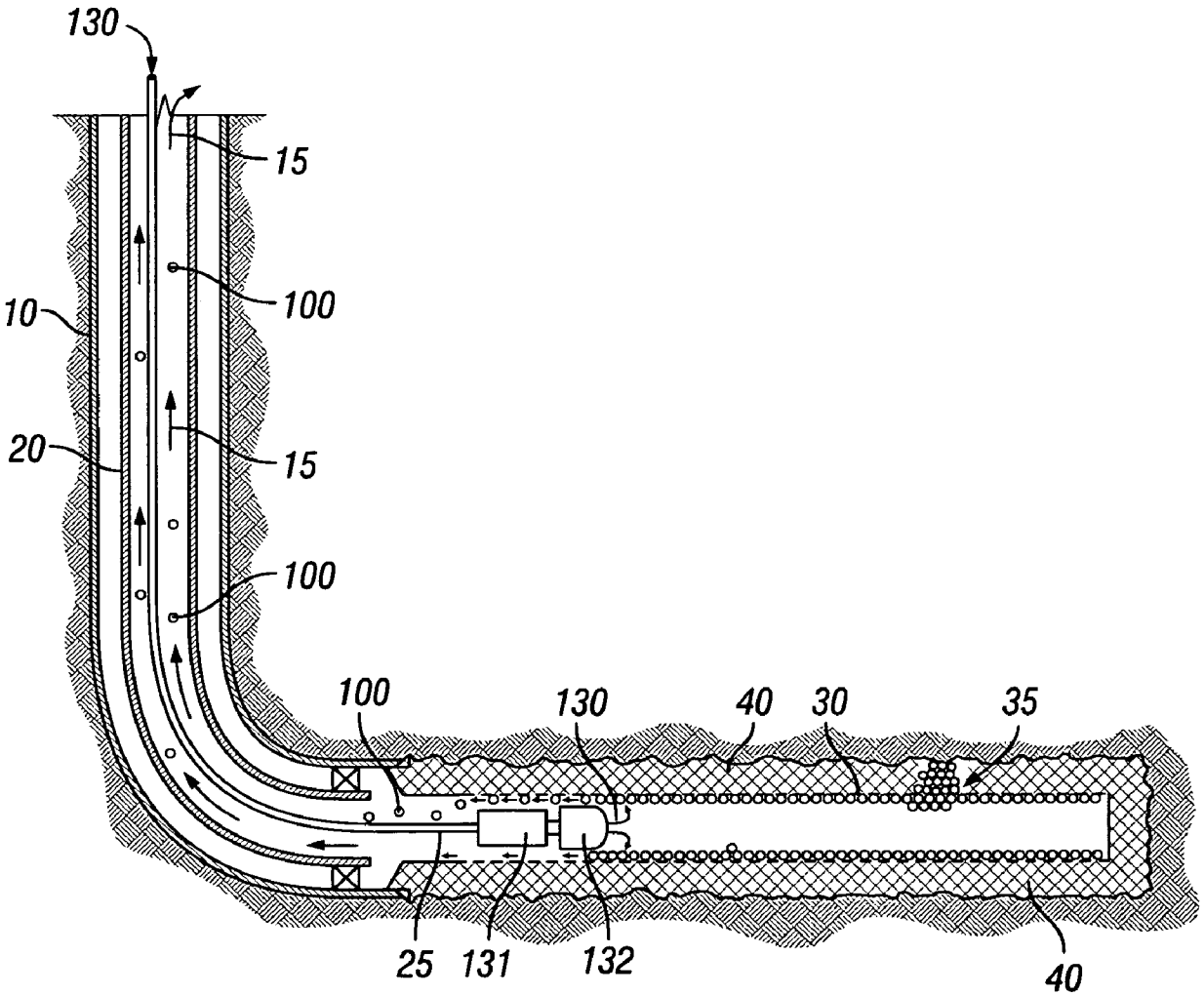
FIG. 7 illustrates removing the excess ultra-lightweight or neutrally buoyant proppant 100 from inside the downhole screen 30 using a motor 131 and a mill 132 connected to the bottom of coiled tubing 25.

As shown in FIG. 7, the cured resin coated ultra-lightweight or neutrally buoyant proppant 100 may accumulate on the inside of the screen 30 and even protrude into the wellbore. Although the ultra-lightweight or neutrally buoyant proppant 100 is porous, the accumulation of the ultra-lightweight or neutrally buoyant proppant 100 may interfere with the production flow. A motor 131 and mill 132 may be ran into the well on the end of the coiled tubing 25. The motor 131 and mill 132 are sized to allow the mill to enter in the screen 30 to cut away the excess ultra-lightweight or neutrally buoyant proppant 100. Preferably, the mill 132 may be comprised of low, non-aggressive cutters to prevent any damage to the base pipe of the screen 30. The ultra-lightweight or neutrally buoyant proppant 100 will be rather easy to mill out. Additionally, because ultra-lightweight or neutrally buoyant proppant 100 is neutrally buoyant, the cuttings may be brought to the surface by circulating a cleanout fluid 130 through the coiled tubing 25 causing the cuttings to flow 15 to the surface.

Figure 8:
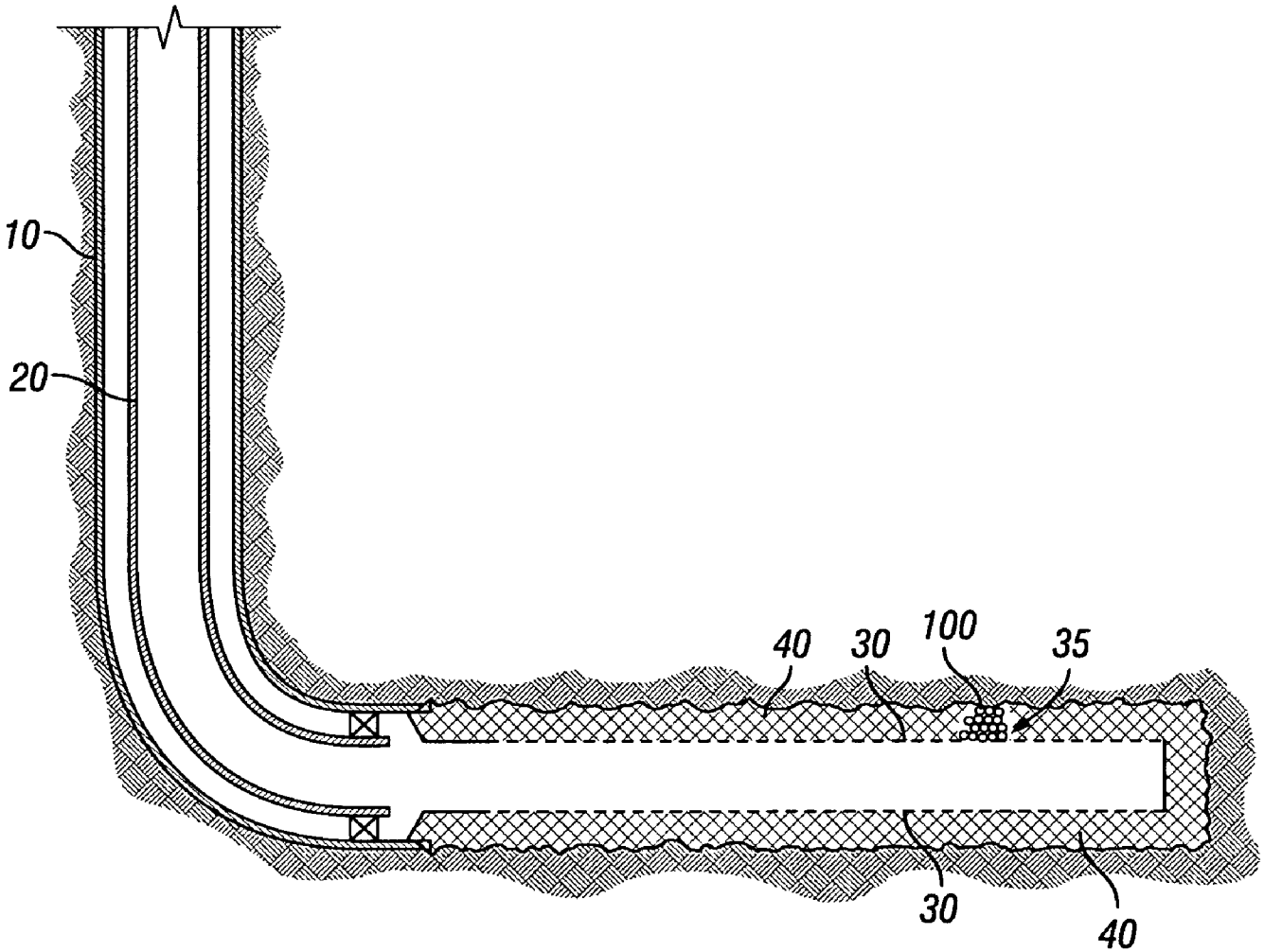
FIG. 8 illustrates the hole 35 in a downhole screen 30 that has been repaired with ultra-lightweight or neutrally buoyant proppant 100 after the excess ultra-lightweight or neutrally buoyant proppant 100 has been removed from the inside of the screen 30.

FIG. 8 shows the wellbore after the excess ultra-lightweight or neutrally buoyant proppant 100 has been removed. The hole 35 in the screen is now filled with ultra-lightweight or neutrally buoyant proppant 100 that has been cured. The ultra-lightweight or neutrally buoyant proppant 100 has been properly sized to prevent the further ingress of sand or other particles from the reservoir from flowing into the well.

Figure 9:
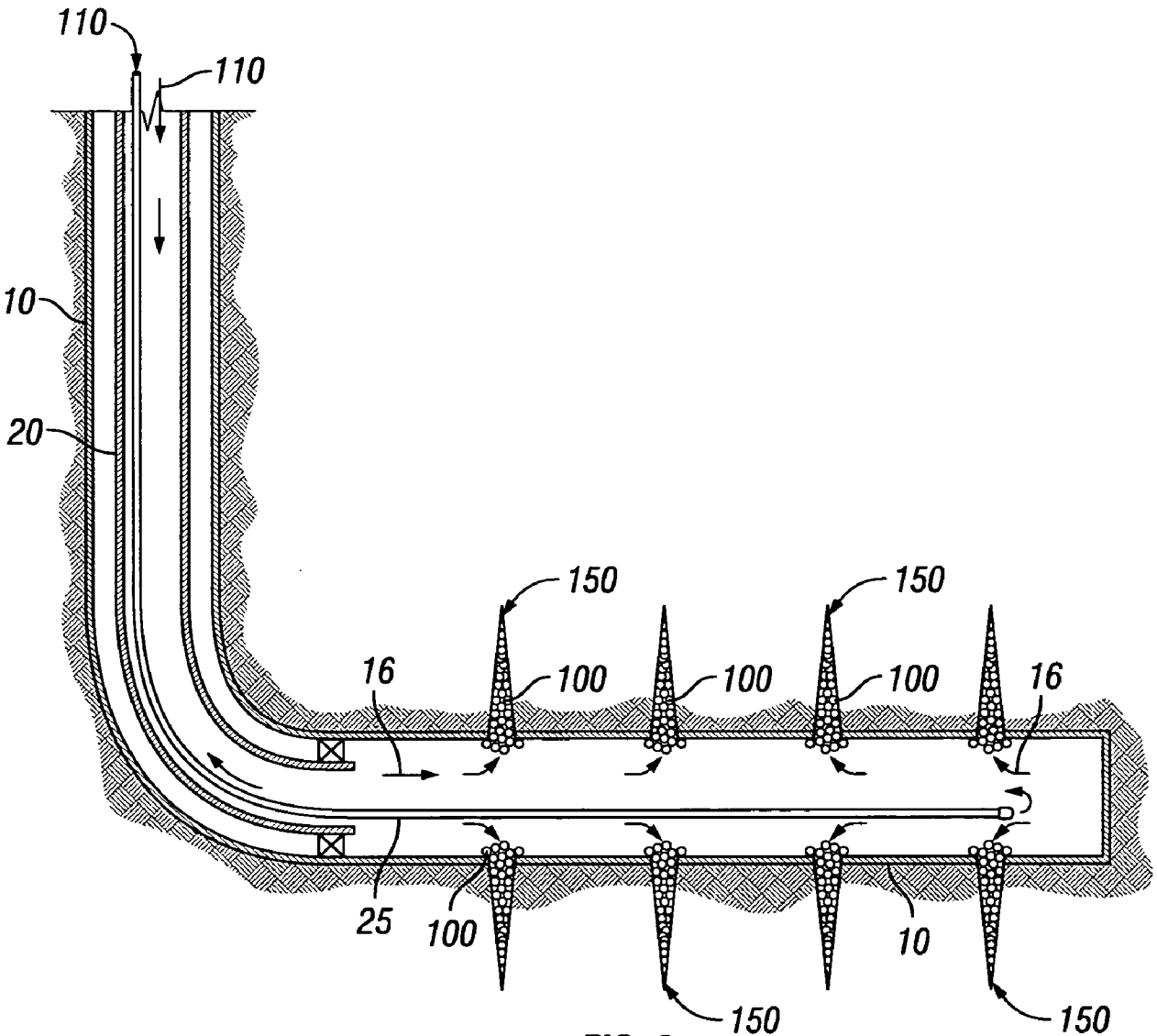
FIG. 9 illustrates pumping displacement fluid 110 into the wellbore of a cased well to displace the carrier fluid into perforation tunnels 150 in the well casing 10. The flow (as indicated by flow arrows 16) of the displacement fluid 110 causes the ultra-lightweight or neutrally buoyant proppant 100 to fill the perforation tunnels 150.

In an alternative embodiment, shown in FIG. 9, the present invention can be used to prevent the production of sand in a cased well. In the same manner that a hole 35 in the screen 30 of a gravel pack can be packed with ultra-lightweight or neutrally buoyant proppant 100, perforation tunnels 150 in the casing 10 of a well can be packed with a ultra-lightweight or neutrally buoyant proppant 100. The ultra-lightweight or neutrally buoyant proppant 100 will not readily gravity segregate in a horizontal well and thus will flow into and fill the perforation tunnels 150. In this embodiment, the same steps applicable to repairing holes in a failed gravel pack may be utilized to either temporarily or permanently control the production of sand in a cased well.

Figure 10:
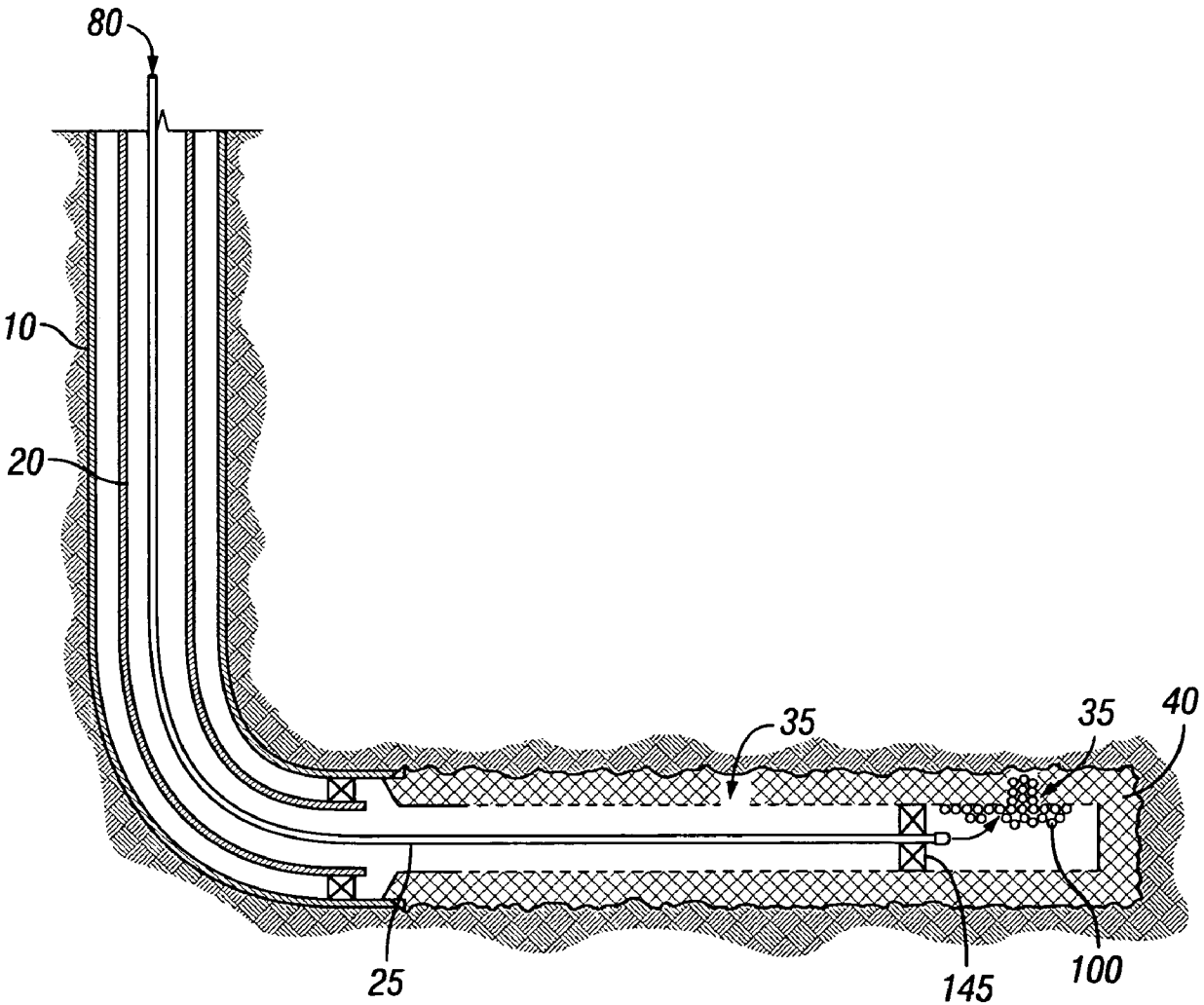
FIG. 10 depicts displacing the wellbore fluid with a carrier fluid 80 containing ultra-lightweight or neutrally buoyant proppant 100 including the use of a single retainer type packer 145 as a selective placement tool to isolate a discrete section of the well.

An additional embodiment of the present invention provides for the use of a selective placement tool, such as the single retainer type packer 145, in gravel packs or cased wells as shown in FIG. 10. The selective placement tool may be used to divide the well into discrete sections prior to pumping the carrier fluid 80 with ultra-lightweight or neutrally buoyant proppant 100 into the well. The division of the well into discrete sections may provide effective placement of the ultra-lightweight or neutrally buoyant proppant 100 within the failed gravel pack or the cased well.

While FIG. 10 depicts the use of a single retainer style packer 145 as the selective placement tool, one of ordinary skill in the art would understand, a variety of selective placement tool may by utilized within the scope of this invention. Examples of such selective placement tools may include two packers using a fixed straddle length, a multi-set bridge plug, release tool, and packer. When using a single retainer style packer 145 as shown in FIG. 10, the selective placement tool may be progressively moved up the well allowing the carrier fluid 80 with ultra-lightweight or neutrally buoyant proppant 100 to be pumped into the well in stages. Because the proppant 100 is either ultra-lightweight or neutrally buoyant it remains dispersed in the wellbore fluid reducing the chance that the proppant may settle within the wellbore and build up into a bed, which could cause the selective placement tool to become stuck within the wellbore.

Although various embodiments have been shown and described, the invention is not so limited and will be understood to include all such modifications and variations as would be apparent to one skilled in the art.

What is claimed is:

1. A method for repairing a gravel pack in a well comprising the steps of:

a) injecting a fluid carrying an ultra-lightweight, resin coated proppant into a gravel pack screen;

b) pumping displacement fluid into said well to assist the flow of said fluid carrying the ultra-lightweight, resin coated proppant into one or more holes in said gravel pack screen; and c) setting the resin on said ultra-lightweight proppant.

2. The method of claim 1, additionally comprising the step of removing excess ultra-lightweight proppant from said well after setting the resin on said ultra-lightweight proppant.

3. The method of claim 1 wherein the ultra-lightweight, resin coated proppant is neutrally buoyant.

4. The method of claim 1, additionally comprising the step of removing sand deposits from said well prior to injecting said fluid carrying an ultra-lightweight proppant.

5. A method for controlling sand production in a well comprising the steps of:

a) injecting a fluid carrying an ultra-lightweight proppant into said well so that said fluid carrying the ultra-lightweight proppant flows into one or more areas of lower resistance to fluid flow;

b) packing said ultra-lightweight proppant in said areas;

c) dislodging excess ultra-lightweight proppant from said well; and d) removing said excess ultra-lightweight proppant.

6. The method of claim 5, wherein said ultra-lightweight proppant is a neutrally buoyant proppant.

7. The method of claim 5, wherein the ultra-lightweight proppant is coated with a reactive coating capable of binding the proppant particles together.

8. The method of claim 7, wherein the reactive coating capable of binding the proppant particles together is a resin.

9. The method of claim 7, additionally comprising the step of setting the reactive coating on said ultra-lightweight proppant.

10. The method of claim 9, wherein said setting the reactive coating is accomplished by a method selected from the group consisting of applying pressure, squeezing said fluid carrying an ultra-lightweight proppant into said areas of lower resistance to fluid flow, thermal setting, and using an activator.

11. The method of claim 5, wherein said ultra-lightweight proppant is selected from the group consisting of a porous particulate material, an organic polymeric particulate material, a porous ceramic particulate material, and divinylbenzene.

12. The method of claim 5, additionally comprising the step of pumping displacement fluid into said well to assist the flow of said fluid carrying the ultra-lightweight proppant into said areas of lower resistance to fluid flow.

13. The method of claim 5, additionally comprising the step of removing sand deposits from said well prior to injecting said fluid carrying an ultra-lightweight proppant.

14. The method of claim 13, wherein a wash nozzle, cleanout fluid and coiled tubing are used to remove said sand deposits from said well.

15. The method of claim 5, wherein said dislodging of excess ultra-lightweight proppant is performed using a motor and a mill.

16. The method of claim 5, wherein said one or more areas of lower resistance to fluid flow are one or more holes in a gravel pack screen.

17. The method of claim 5, wherein said one or more areas of lower resistance to fluid flow are one or more perforation tunnels.

18. A method for controlling sand production in a well comprising the steps of:

a) running a selective placement tool into said well;

b) using said selective placement tool to divide said well into discrete sections;

c) pumping a fluid carrying an ultra-lightweight proppant into one or more discrete sections of said well so that said fluid carrying the ultra-lightweight proppant flows into areas of lower resistance to fluid flow within said one or more discrete sections of said well; and d) packing said ultra-lightweight proppant in said areas;

e) dislodging excess ultra-lightweight proppant from said well; and f) removing said excess ultra-lightweight proppant.

19. The method of claim 18, wherein said ultra-lightweight proppant is a neutrally buoyant proppant.

20. The method of claim 18, wherein the ultra-lightweight proppant is coated with a reactive coating capable of binding the proppant particles together.

21. The method of claim 20, wherein the reactive coating capable of binding the proppant particles together is a resin.

22. The method of claim 20, additionally comprising the step of setting the reactive coating on said ultra-lightweight proppant.

23. The method of claim 22, wherein said setting the reactive coating is accomplished by a method selected from the group consisting of applying pressure, squeezing said fluid carrying an ultra-lightweight proppant into said areas of lower resistance to fluid flow, thermal setting, and using an activator.

24. The method of claim 18, wherein said ultra-lightweight proppant is selected from the group consisting of a porous particulate material, an organic polymeric particulate material, a porous ceramic particulate material, and divinylbenzene.

25. The method of claim 18, additionally comprising the step of pumping displacement fluid into said well to assist the flow of said fluid carrying the ultra-lightweight proppant into said areas of lower resistance to fluid flow.

26. The method of claim 18, additionally comprising the step of removing sand deposits from said well prior to injecting said fluid carrying an ultra-lightweight proppant.

27. The method of claim 18, wherein said one or more areas of lower resistance to fluid flow are one or more holes in a gravel pack screen.

28. The method of claim 18, wherein said one or more areas of lower resistance to fluid flow are one or more perforation tunnels.

* * * * *